US006499439B1

(12) United States Patent
Kohler et al.

(10) Patent No.: US 6,499,439 B1
(45) Date of Patent: Dec. 31, 2002

(54) MODULAR STAMPED SIGHT GLASS ASSEMBLY

(75) Inventors: Jurgen Kohler, Medina, OH (US); Ralph Kacik, North Royalton, OH (US); Ronald Roskavich, North Royalton, OH (US)

(73) Assignee: Triad Metal Products Company, Parma, OH (US)

( * ) Notice: Subject to any disclaimer, the term of this patent is extended or adjusted under 35 U.S.C. 154(b) by 0 days.

(21) Appl. No.: 09/882,902

(22) Filed: Jun. 15, 2001

(51) Int. Cl.[7] ..... G01F 23/02

(52) U.S. Cl. ..... 122/19.2; 73/323; 73/328; 73/330

(58) Field of Search ..... 122/13.01, 17.1, 122/19.2, 30, 37, 494, 497; 220/495.01, 567.3; 73/323, 328, 330

(56) References Cited

U.S. PATENT DOCUMENTS

| | | | | |
|---|---|---|---|---|
| 3,888,205 | A | | 6/1975 | Vitticore et al. |
| 3,941,460 | A | | 3/1976 | Meginnis |
| 3,977,251 | A | | 8/1976 | Meginnis |
| 4,162,826 | A | | 7/1979 | Van der Beck et al. |
| 4,169,309 | A | | 10/1979 | Meginnis |
| 4,182,179 | A | | 1/1980 | Meginnis |
| 4,194,398 | A | | 3/1980 | Gastrock |
| 4,206,537 | A | | 6/1980 | Meginnis |
| 4,224,047 | A | | 9/1980 | Kershaw |
| 4,436,375 | A | | 3/1984 | Meginnis |
| 4,441,365 | A | | 4/1984 | Schulz et al. |
| 4,446,731 | A | | 5/1984 | Martin |
| 4,455,996 | A | * | 6/1984 | Achilles, Sr. ..... 126/312 |
| 4,468,095 | A | | 8/1984 | Meginnis |
| 4,541,277 | A | | 9/1985 | Starnes, Jr. |
| 4,557,216 | A | | 12/1985 | Demyon |
| 4,803,876 | A | | 2/1989 | Haynes |
| 4,807,474 | A | | 2/1989 | Foster |
| 4,809,862 | A | | 3/1989 | Canty |
| 4,827,770 | A | | 5/1989 | Schwartz et al. |
| 4,838,095 | A | | 6/1989 | Sheridan et al. |
| 4,877,668 | A | | 10/1989 | Hinz et al. |
| 4,888,990 | A | | 12/1989 | Bryan et al. |
| 5,076,198 | A | | 12/1991 | Bottum |
| 5,125,269 | A | | 6/1992 | Horst, Jr. |
| 5,184,511 | A | | 2/1993 | Barrows et al. |
| D334,940 | S | | 4/1993 | Wolinsky |
| 5,210,658 | A | | 5/1993 | Foster |
| 5,284,105 | A | | 2/1994 | Wilkins |
| 5,383,338 | A | | 1/1995 | Bowsky et al. |
| 5,406,844 | A | | 4/1995 | May, III et al. |
| 5,611,241 | A | * | 3/1997 | Henry et al. ..... 73/323 |
| 5,628,231 | A | | 5/1997 | Sheridan |
| 5,735,168 | A | | 4/1998 | Harrison |
| 5,763,776 | A | | 6/1998 | Birch et al. |
| D412,454 | S | | 8/1999 | Berkelhammer |
| 5,974,877 | A | | 11/1999 | Burgess et al. |
| D423,538 | S | | 4/2000 | Dillon |
| 6,082,972 | A | | 7/2000 | Moore, Jr. et al. |
| 6,116,195 | A | | 9/2000 | Valcic et al. |
| 6,116,274 | A | | 9/2000 | Ehrlich |
| D435,055 | S | | 12/2000 | Puigcerver et al. |
| 6,295,952 | B1 | * | 10/2001 | Reynolds et al. ..... 122/14.31 |

* cited by examiner

*Primary Examiner*—Gregory Wilson
(74) *Attorney, Agent, or Firm*—Arter & Hadden LLP

(57) ABSTRACT

A sight glass assembly for a water heater flame trap and a method of making same is disclosed. A rectangular-shaped sight glass frame casing being comprised of a thin metal plate further comprising a rounded rectangular cut-out window and two metal tabs on opposite sides of the casing acting as a retainer to hold the planar transparent material of the sight window tight to the rectangular-shaped gasket. The metal frame casing of the sight glass assembly attaches to the exterior of the flame trap compartment of the hot water heater by: (a) either inserting the tabs, further comprising metal clips, into the gasket whereby they expand, locking the metal frame casing in place; or in a second embodiment (b) riveting the tabs, now in the shape of a flange, directly to the hot water heater shell. The metal frame casing is formed by a metal stamping procedure that allows for easier and more economic manufacture of the sight glass retainer.

32 Claims, 4 Drawing Sheets

MODULAR STAMPED SIGHT GLASS ASSEMBLY

FIELD OF THE INVENTION

The present invention pertains generally to sight glass assemblies and, more particularly, to low cost modular sight glass assemblies which are suitable for installation where vapor control is required.

BACKGROUND OF THE INVENTION

Sight glass assemblies are widely used in many different types of machines and vessels to observe internal workings. For many installations, the sight glass window and the surrounding framework must be appropriately engineered to withstand and contain the internal environment. This can require a complex assembly of parts, including bezels with multiple interfacing components, and glass or transparent layers with highly engineered interfaces between the glass and the bezel housing. For example, U.S. Pat. Nos. 3,941,460; 3,977,251; 4,169,309; 4,182,179; 4,206,537; 4,436,375; 4,468,095; 5,210,658 and 5,763,776 all disclose complex sight glass assemblies with heavy machined frame structures secured about a glass piece and attached to a vessel in high pressure or corrosive environments. These types of assemblies are of course costly to produce, assemble and install, and are therefore generally found on specialized industrial equipment, such as chemical and food processing equipment. Because it is critical in these applications to maintain the view path for inspection of internal conditions, these types of highly engineered sight glass assemblies are justified.

In other applications, the environment may be less hostile or corrosive, allowing for a less complex construction. For example, U.S. Pat. No. 5,735,168 discloses a sight glass assembly for use on an animal feeder that does not require access to the interior, but which contains multiple layers and at least four fasteners for attachment to a wall. In other words, the design and construction of a sight glass assembly is highly dependent upon the installation environment.

The development of new type of water heater has created a new application for an effective yet economical sight glass assembly. Until recently water heaters have been manufactured with the pilot light and burner contained in a open air shroud underneath the water tank. This allows flammable vapors to easily come into contact with the open flame of the pilot or burner and cause an uncontrolled explosion or fire. To prevent this, a vapor-controlled flame chamber has been developed for use with a water heater. As described for example by U.S. Pat. No. 6,116,195, an enclosed flame trap assembly for water heaters has an air inlet in the form of a plate with a plurality of ports, each port being sized and shaped to cause air and extraneous fumes to pass through the ports at a velocity higher than the flame velocity of the extraneous fumes, to confine ignition and combustion of extraneous fumes within the combustion chamber. More specifically, the patent describes the exact design of openings or "ports" in the air inlet which inhibit flames from ignition of extraneous fumes from exiting the flame trap assembly. This greatly reduces the risk of accidental home fires caused by flammable vapors coming into contact with the flame of the water heater burner. This innovation has been heralded as a significant safety improvement in water heater home safety by the U.S. Consumer Product Safety Commission. The flame trap assembly however, is otherwise substantially sealed, which interferes with inspection of the pilot and burner flame.

Thus the need is created to incorporate a sight glass into this type of flame trap assembly to enable visual inspection of the burner assembly and operation, particularly with respect to gas flow in the absence of a flame, which could lead to gas poisoning or uncontrolled explosion.

This type of sight glass is primarily subject to heat, rather than pressure. Otherwise, the primary performance criteria (in addition to providing the view path) is to maintain the vapor control integrity of the flame trap assembly. Therefore, a principal objective of the invention is to provide a sight glass assembly which maintains the vapor control function of the flame trap assembly but which is economical for mass production in flame trap equipped water heaters.

SUMMARY OF THE INVENTION

The present invention provides novel solutions to these and other aspects of water heater flame control systems, by providing a modular sight glass assembly frame that does not require custom fasteners or fittings, but still creates a sufficient seal and window area. The design is also economical to produce and assemble. In one embodiment the securing tabs allow for the sight glass assembly to be easily snapped into position on the exterior of the flame trap compartment. In another, the sight glass assembly is secured by two rivet-like fasteners, allowing for a more flexible placement and less cutout area in the flame trap assembly compartment wall.

In accordance with one general aspect of the invention, there is provided a sight glass assembly with frame casing having a front face, side walls, an upper wall, a lower wall, an opening in the front face, and securment extensions which extend from at least two of the side walls; a piece of planar transparent material having an outer perimeter dimensioned to fit within the walls of the frame, and to span the opening in the front face, wherein the walls extend over the edges of the transparent material; a generally planar gasket having an outer perimeter greater than an outer perimeter of the casing, and an opening having a perimeter less than the outer perimeter of the transparent material wherein the securement extensions are configured to engage with a structure having an opening generally aligned with the openings in the gasket and the frame to provide a sight glass through the opening in the structure.

In accordance with another general aspect of the invention, there is provided a modular sealed sight glass assembly adapted for attachment to a wall section to provide a sealed view path, including a frame having a planar face wall and an opening in the face wall defining a viewing port; framing walls extending generally perpendicularly from a perimeter of the face wall, at least one of the framing walls further comprising a securement extension; a piece of transparent material dimensioned to fit within the framing walls and against the face wall; a gasket having an outer perimeter greater than the face wall of the frame, and an internal opening having a perimeter less than a perimeter of the piece of transparent material, the internal opening of the gasket being generally aligned with the opening in the face wall, and the gasket being positioned against the transparent material opposite to the face wall of the frame.

And in accordance with another aspect of the invention, there is provided a sight glass assembly in combination with a combustion chamber, the combustion chamber having a shroud with at least one wall and an opening through a cross-section of the shroud wall, a sight glass frame having a face plate with an opening and perimeter walls which extend perpendicularly from the face plate, a planar transparent piece which fits within the perimeter walls of the frame and against the face plate, and a gasket with an opening which corresponds to the opening in the face plate and the opening in the shroud wall and which extends at least partially beyond a perimeter of the face plate, the gasket being positioned against the shroud wall and about the opening in the shroud wall, and the transparent material and face plate being positioned over the gasket and attached to the shroud wall.

These and other aspects of the invention are herein described with reference to the accompanying Figures representative of several of many possible embodiments of the principles and concepts of the invention.

DETAILED DESCRIPTION OF PREFERRED AND ALTERNATE EMBODIMENTS

Figure 1:
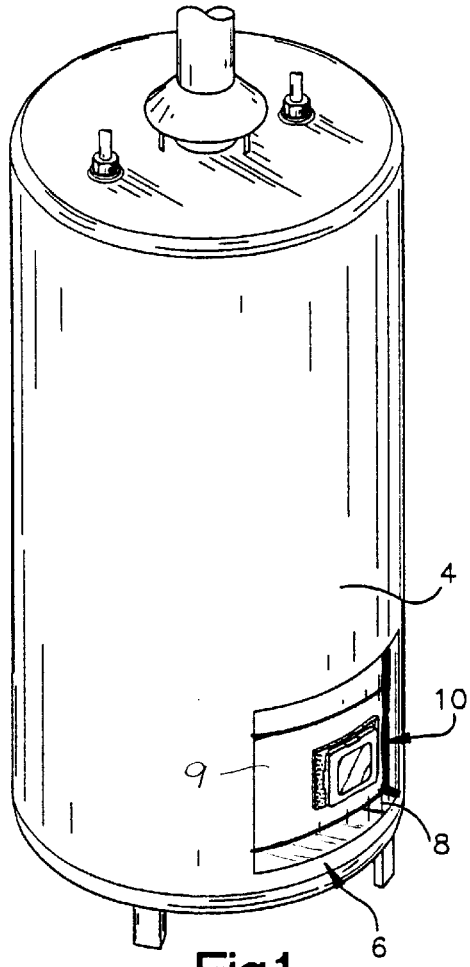
FIG. 1 is an isometric view of the sight glass assembly installed in a generic water heater.
Figure 2:
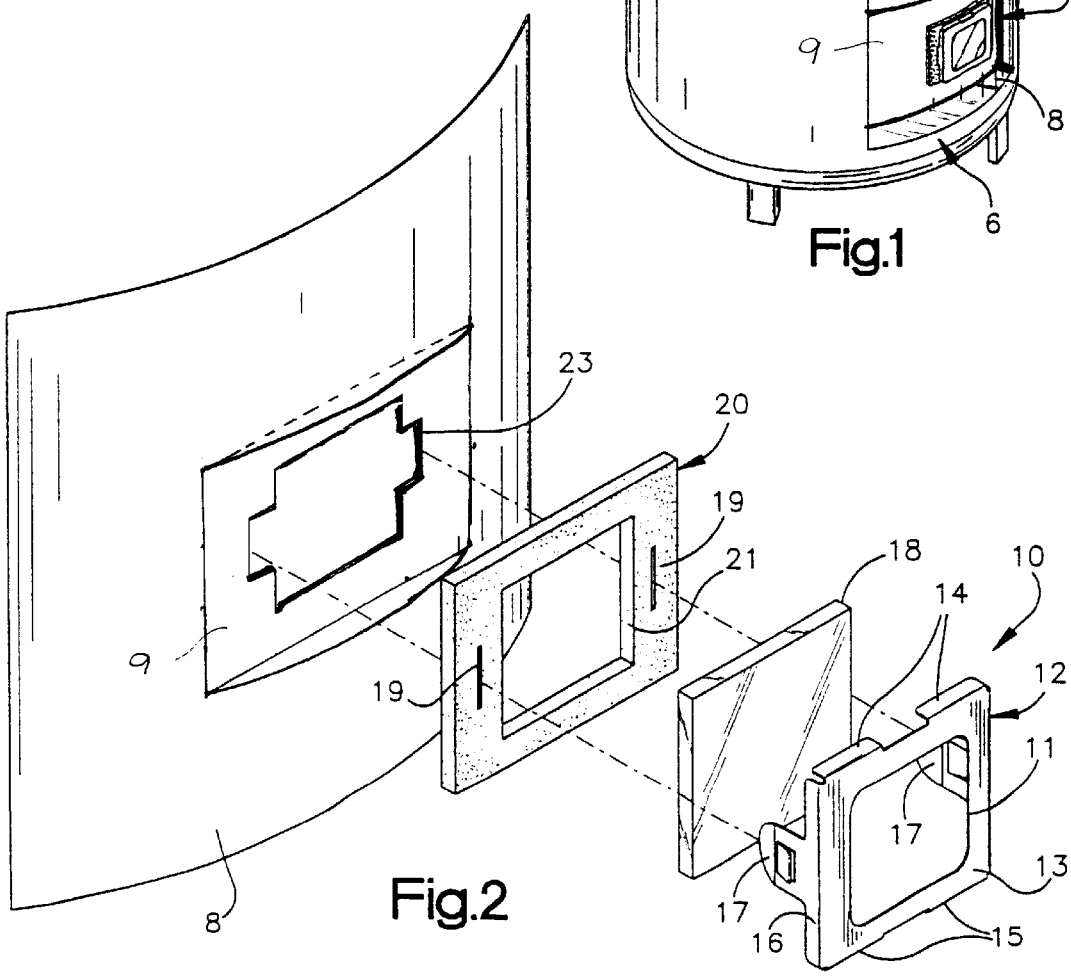
FIG. 2 is an exploded isometric view of the elements of the first embodiment of the sight glass assembly.
Figure 3:
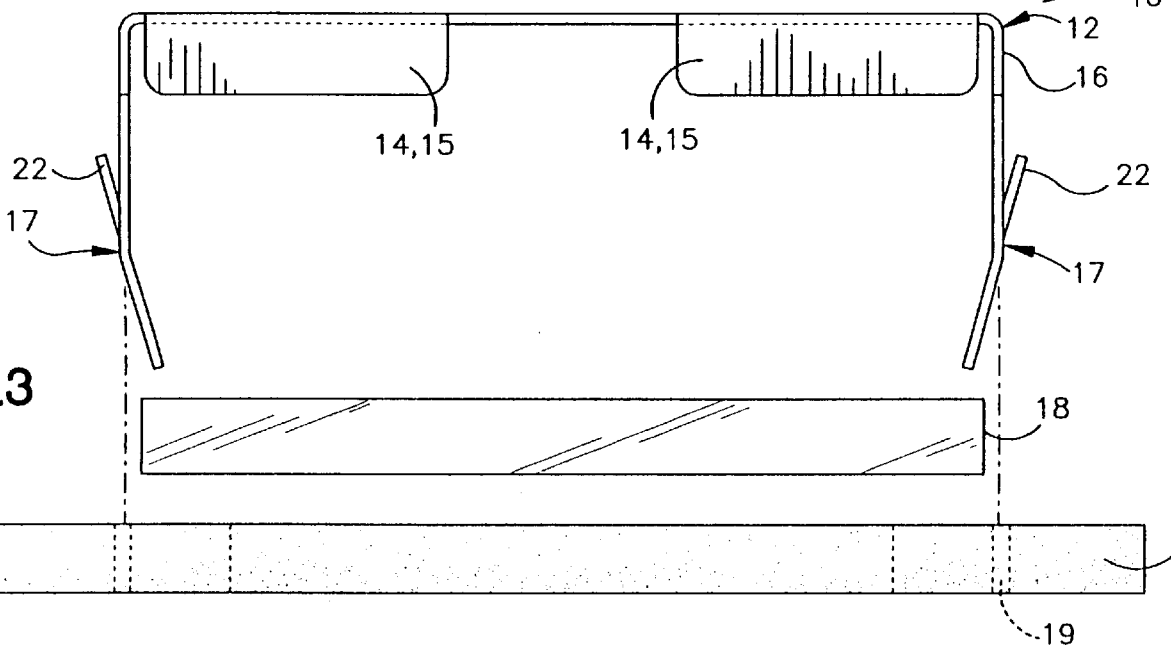
FIG. 3 is an exploded side view of the first embodiment of the sight glass assembly.
Figure 4:
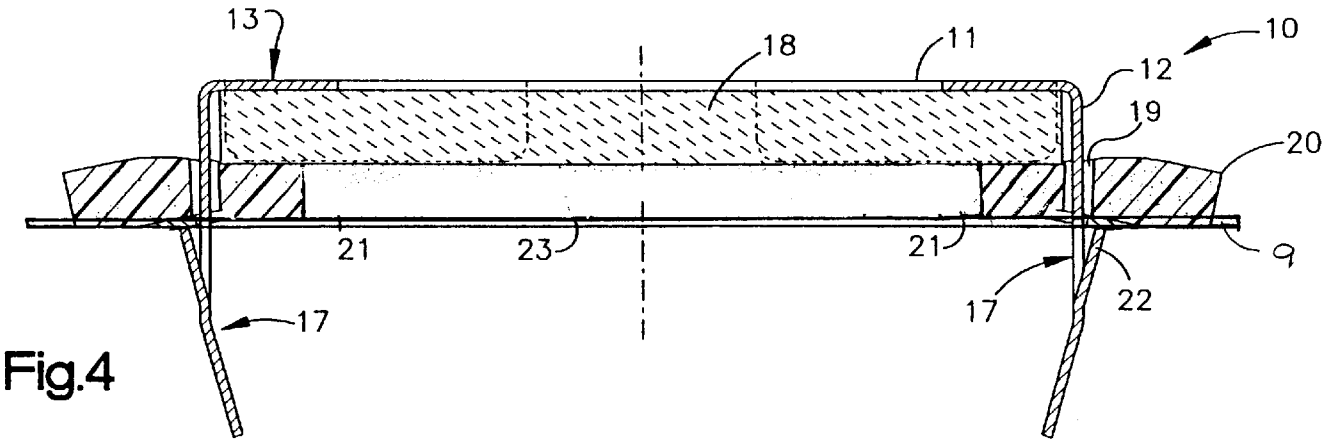
FIG. 4 is a cross-sectional view of the first embodiment of the sight glass assembly as installed in a generic water heater.

A first embodiment of the sight glass assembly 10 is shown in FIGS. 2 through 4. The sight glass assembly 10 is attached to the cover panel 8 of the flame trap compartment 6 of a water heater 4, wherein the flame trap assembly compartment is located generally below the water tank. The cover panel 8 or an area thereof such as recessed area 9, may be flat, planar, and slightly recessed from the curved cylindrical exterior wall of the water heater 4, or of the same curvature of the cylindrical exterior wall. The flame trap compartment 6 is also generally referred to herein as a "shroud", and the wall of the flame trap compartment or the cover panel as a "shroud wall". The sight glass assembly 10 comprises a metal frame or casing 12, a piece of planar transparent material 18, e.g., made of glass or plastic, and a generally planar flexible gasket 20. The frame 12 has a top wall 14, a bottom wall 15, and two opposed side walls 16, formed generally as angled flanges from a face 13 of the frame. Walls 14, 15 and 16 are also referred to herein as "perimeter walls". Face 13 is also referred to as a "face plate". The top wall 14 and bottom wall 15 are formed by two rounded tabs or flap-like elements bent generally 90° from the face 13 of the frame 12. Preferably, the extent of the walls 14 and 15 from face 13 is less than or equal to, and not greater than, the thickness of the planar transparent material 18.

The transparent planar material 18 may be a type of glass, colored or clear, so long as it allows the status of the flame to be determined. The gasket 20, 33 material may be made of a flexible polymer or rubber that will sufficiently create the necessary seal to isolate the inner flame trap assembly from exterior elements.

In this embodiment, each side wall 16 has a securing tab 17 or "securement extension" which extends from an edge of the wall 16 opposite face 13. Tabs 17 are configured to extend through the slots 19 in the flexible gasket 20 and into the cover panel 8 of the flame trap compartment 6, such as by engaging a perimeter portion of opening 23 in cover panel 8, or through a similar opening in a wall section of any other installation or application.

Frame 12 has an opening 11 formed in the front face 13, generally equal in size and preferably smaller than a corresponding opening 21 in the flexible gasket 20. The planar transparent material 18 is dimensioned to fit within the four walls (14, 15 and 16) of the frame 12, and to completely cover the gasket opening 21, as shown in the assembled state in cross-section in FIG. 4.

The frame 12 is preferably a single piece stamping made of appropriate steel, such as for example Martinsite M130, in a progressive or sequential die cutting and stamping operation, wherein the frame is die cut as a single piece, and each of the perimeter walls and tabs formed by conventional stamping methods. This enables high speed production of frames to close finished tolerances, with the strength required to securely hold the assembly in place when installed, and to establish the desired vapor seal with the transparent layer and gasket. Other forms of manufacture of the frame, such as by molding of engineered plastic material is also within the scope of the invention.

The combination of the frame 12, transparent layer 18 and gasket 20 provides a modular sight glass assembly suitable for use in a wide variety of applications, and particularly suited for vapor-controlled installations such as the described water heater flame trap assemblies. The modular sight glass assembly is particularly advantageous to the manufacturer of the end product as it can be provided as a pre-assembled unit ready for final installation, as further described. This produces substantial cost savings over conventional manufacturing and assembly operations wherein each component of a sight glass is handled separately.

As further shown in FIGS. 2–4, to install the sight glass assembly in the described water heater flame trap, the frame 12 is aligned with the opening 23 and pressed against cover panel 8 to engage the tangs 22 of tabs 17 with the perimeter of opening 23. The tangs 22 are sprung to extend past the edges of opening 23 once inserted beyond cover panel 8, in permanent compressive engagement of the frame 12 against the transparent layer 18, gasket 20 and cover panel 8, to provide a vapor-proof sight glass in the water heater flame trap. This embodiment substantially reduces the amount of time required for installation of a sight glass assembly in the flame trap type water heater.

Figure 5:
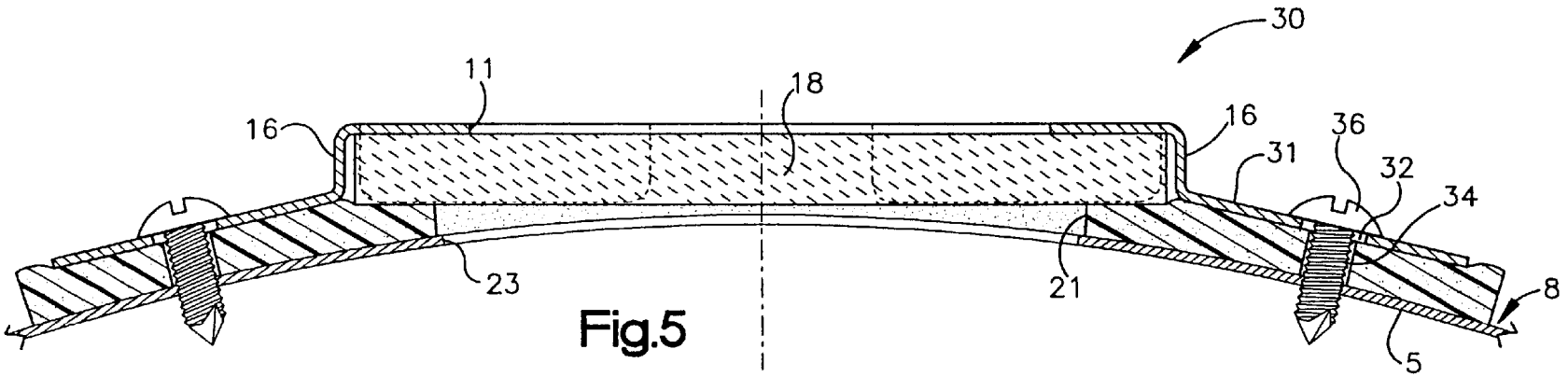
FIG. 5 is a cross-sectional view of the second embodiment of the sight glass assembly as installed in a generic water heater.
Figure 5A:
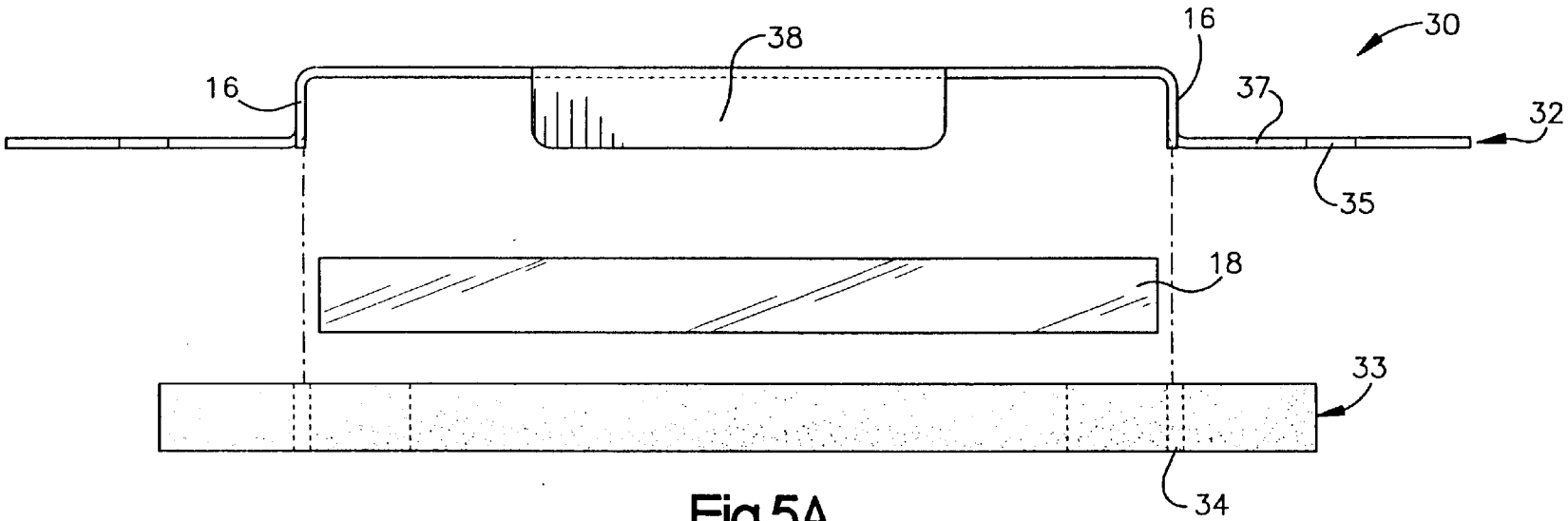
FIG. 5A is an exploded side view of the elements in the second embodiment of the sight glass assembly with a modified side wall design.
Figure 6:
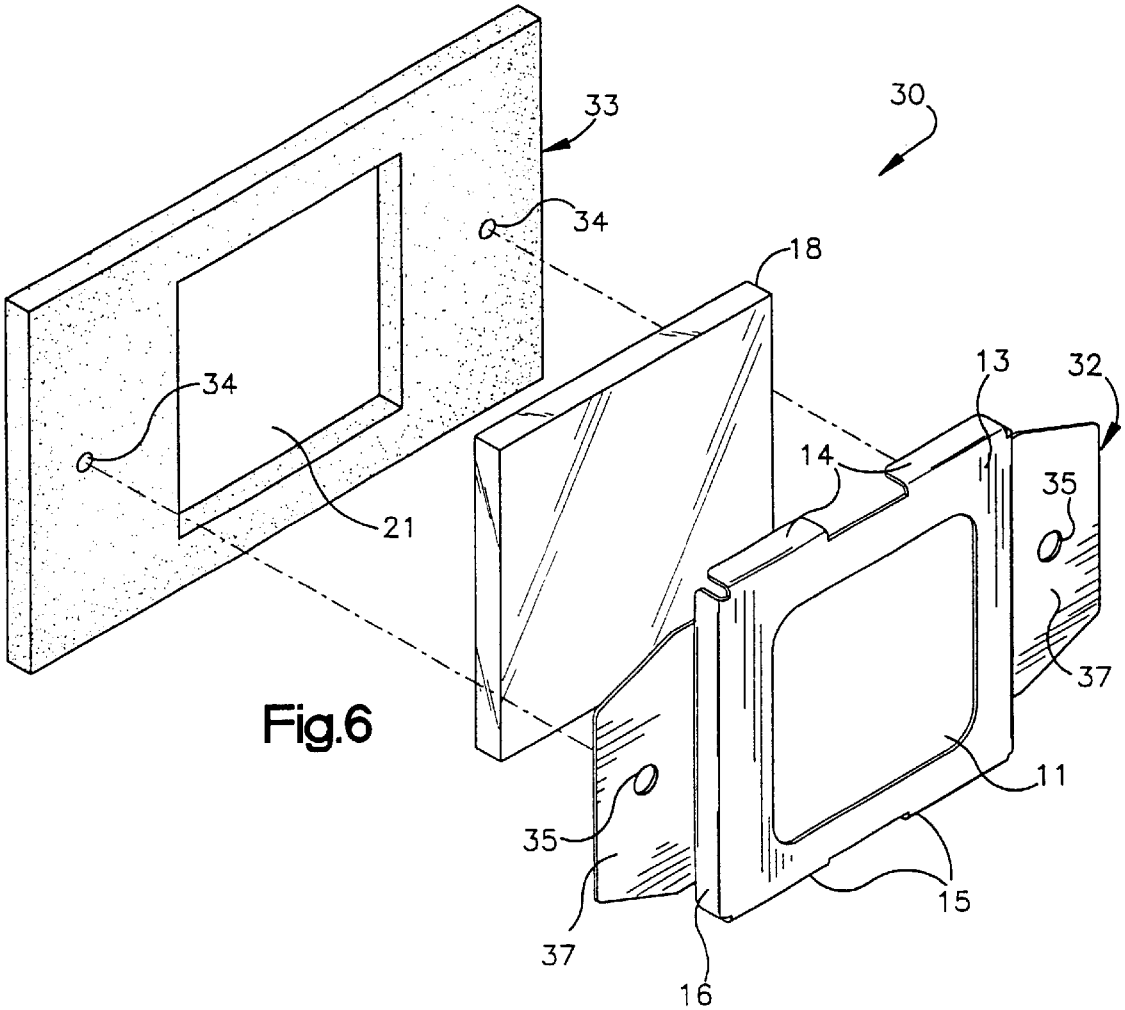
FIG. 6 is an exploded isometric view of the second embodiment of the sight glass assembly.

An alternate embodiment of a modular vapor-proof sight glass assembly 30 is shown in FIG. 5, FIG. 5A, and FIG. 6. This embodiment 30 differs mainly from the first embodiment 10 with respect to the manner of attachment of the frame 12 to the cover panel 8 of the flame trap compartment 6. In this case, the side walls 16 have a securing flange 37 which extends in the plane generally parallel to the front face 13 of frame 32. Each flange 37 has a circular opening 35 for fastener 36 such as a rivet, screw or other suitable device to extend through the flange 37 and the wall section of the cover panel 8.

The gasket 33 extends to meet the dimensions of the modified frame 32, i.e. to traverse substantially the entire width of the frame 37, and contains two openings 34 which correspond in location with the fastener openings 35 in the frame 32.

FIG. 5A illustrates an alternate embodiment of the sight glass assembly frame 32, wherein the top wall 14 and the bottom wall 15 are formed by a single tab or flap-like element 38 bent away from the face 13 of the frame 32. The single tab 38 is centered on the wall, generally equidistant from the side walls 16, which creates a stiffer overall structure and consequent increased effectiveness in establishing the vapor barrier by compression of the gasket against the cover panel.

The invention thus provides a cost-efficient modular sight glass assembly configured for a wide variety of installations, and particularly suited for use in a vapor-controlled environment such as the described flame trap, or other types of gas or combustion vessels or devices. The sight glass assembly is preferably pre-assembled for final installation as a modular unit.

What is claimed is:

1. A sight glass assembly comprising (a) a frame casing having a front face, side walls, an upper wall, a lower wall, an opening in the front face, and securment extensions which extend from at least two of the side walls;

(b) a piece of planar transparent material having an outer perimeter dimensioned to fit within the walls of the frame, and to span the opening in the front face, wherein the walls extend over the edges of the transparent material;

(c) a generally planar gasket having an outer perimeter greater than an outer perimeter of the casing, and an opening having a perimeter less than the outer perimeter of the transparent material wherein the securement extensions are configured to engage with a structure having an opening generally aligned with the openings in the gasket and the frame to provide a sight glass through the opening in the structure.

2. The sight glass assembly of claim 1 wherein the walls of the frame are oriented approximately ninety degrees relative to the front face of the frame.

3. The sight glass assembly of claim 1 wherein the securement extensions extend in generally the same plane as the corresponding wall.

4. The sight glass assembly of claim 1 wherein the securement extensions extend in a plane generally parallel to the front face of the frame.

5. The sight glass assembly of claim 1 wherein the securement extensions are spring to compressively engage about an opening in a structure.

6. The sight glass assembly of claim 1 wherein at least one of the securement extensions is configured to receive a fastener for attaching the frame to a structure.

7. The sight glass assembly of claim 1 wherein the gasket has an outer perimeter dimensioned to extend beyond an opening in a structure.

8. The sight glass assembly of claim 1 wherein the walls of the frame extend away from the face to an extent not greater than a thickness of the transparent material.

9. The sight glass assembly of claim 1 wherein the securement extensions extend through the gasket.

10. The sight glass assembly of claim 1 wherein the securement extensions overlie peripheral portions of the gasket.

11. A modular sealed sight glass assembly adapted for attachment to a wall section to provide a sealed view path, the assembly comprising:

a frame having a planar face wall and an opening in the face wall defining a viewing port;

framing walls extending generally perpendicularly from a perimeter of the face wall, at least one of the framing walls further comprising a securement extension;

a piece of transparent material dimensioned to fit within the framing walls and against the face wall;

a gasket having an outer perimeter greater than the face wall of the frame, and an internal opening having a perimeter less than a perimeter of the piece of transparent material, the internal opening of the gasket being generally aligned with the opening in the face wall, and the gasket being positioned against the transparent material opposite to the face wall of the frame.

12. The sight glass assembly of claim 11 wherein a perimeter of the frame is generally rectangular.

13. The sight glass assembly of claim 11 wherein the framing walls extend from the face wall to substantially cover edges of the transparent material.

14. The sight glass assembly of claim 11 comprising a single framing wall extending from each perimeter of the face wall.

15. The sight glass assembly of claim 11 comprising more than one framing wall extending from a perimeter of the face wall.

16. The sight glass assembly of claim 11 wherein edges of the framing walls contact the gasket, and wherein at least a portion of the gasket extends beyond the framing walls.

17. The sight glass assembly of claim 11 wherein a securement extension extends through the gasket.

18. The sight glass assembly of claim 11 wherein a securement extension substantially overlies a portion of the gasket which extends beyond the framing walls.

19. The sight glass assembly of claim 11 in combination with a wall section of a chamber, wherein the wall section has an opening which corresponds with the opening in the face wall.

20. A sight glass assembly in combination with a combustion chamber, the combustion chamber having a shroud with at least one wall and an opening through a cross-section of the shroud wall, a sight glass frame having a face plate with an opening and perimeter walls which extend perpendicularly from the face plate, a planar transparent piece which fits within the perimeter walls of the frame and against the face plate, and a gasket with an opening which corresponds to the opening in the face plate and the opening in the shroud wall and which extends at least partially beyond a perimeter of the face plate, the gasket being positioned against the shroud wall and about the opening in the shroud wall, and the transparent material and face plate being positioned over the gasket and attached to the shroud wall.

21. The sight glass assembly combination of claim 20 in further combination with a water tank wherein the combustion chamber is a heat source for the water tank.

22. The sight glass assembly combination of claim 20 wherein the sight glass frame is formed as a metal stamping.

23. The sight glass assembly combination of 20 wherein the sight glass assembly is attached to the shroud wall by a fastener.

24. The sight glass assembly combination of claim 20 wherein the sight glass assembly is attached to the shroud wall by a securement extension which extends from a perimeter wall of the sight glass frame.

25. The sight glass assembly combination of claim 20 wherein the gasket is in a partially compressed state between the transparent piece and the shroud wall.

26. The sight glass assembly combination of claim 20 wherein the securement extensions extend through the shroud wall.

27. The sight glass assembly combination of claim 20 wherein the securement extensions extend laterally from the perimeter walls of the sight glass frame.

28. The sight glass assembly combination of claim 20 wherein the perimeter walls of the sight glass frame extend away from the face plate a distance less than a thickness dimension of the transparent piece.

29. The sight glass assembly combination of claim 20 in combination with a water heater, wherein the combustion chamber is located beneath a water tank of the water heater.

30. The sight glass assembly combination of claim 20 wherein the sight glass assembly is generally aligned with a combustion source within the combustion chamber.

31. A flame trap equipped water heater having:

a water reservoir;

an open flame source positioned proximate to the water reservoir and housed within a flame trap compartment;

the flame trap compartment at least partially enclosed by a cover panel attached to an exterior of the water heater, the cover panel having an opening;

a sight glass assembly attached to the cover panel about the opening, the sight glass assembly having a face plate with an opening which corresponds to the opening in the cover panel and which is configured to position and secure a transparent piece over the corresponding openings and to position and secure a gasket between the transparent piece and a periphery of the opening in the cover panel about the corresponding openings.

32. A sight glass assembly comprising:

(a) a frame having a front face, side walls, an upper wall, a lower wall, an opening in the front face defining a viewing port, and securement extensions which extend from the side walls and wherein the securement extensions are spring biased;

(b) a piece of planar transparent material having an outer perimeter dimensioned to fit within the walls of the frame, and to span the opening in the front face, wherein the walls extend over the edges of the transparent material, and;

(c) a generally planar gasket having an internal opening with a perimeter less than the outer perimeter of the transparent material, the gasket not extending beyond the walls of the frame.

* * * * *